US006023258A

United States Patent [19]

Kuriyama et al.

[11] Patent Number: 6,023,258

[45] **Date of Patent: *Feb. 8, 2000**

[54] FLAT DISPLAY

[75] Inventors: Hirohito Kuriyama; Toshio Ueda; Keiichi Kaneko; Akira Yamamoto, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/624,054

[22] Filed: Mar. 29, 1996

Related U.S. Application Data

[63] Continuation of application No. 08/188,709, Jan. 31, 1994, abandoned.

[30] Foreign Application Priority Data

Nov. 19, 1993 [JP] Japan ..... 5-290881

[51] Int. Cl.[7] ..... G09G 3/28

[52] U.S. Cl. ..... 345/60; 345/208; 345/213

[58] Field of Search ..... 345/94, 87, 55, 345/60, 65, 202, 212; 315/169.4; 313/581, 484

[56] References Cited

U.S. PATENT DOCUMENTS

| | | | |
|---|---|---|---|
| 3,906,290 | 9/1975 | Kurahashi et al. | 345/63 |
| 4,638,310 | 1/1987 | Ayliffe | 345/94 |
| 5,313,225 | 5/1994 | Miyadera | 345/211 |

FOREIGN PATENT DOCUMENTS

| | | |
|---|---|---|
| 0366117 | 5/1990 | European Pat. Off. . |
| 0 488 891 | 6/1992 | European Pat. Off. . |

OTHER PUBLICATIONS

H. Uchiike et al., "85–Lines per inch High–Resolution Full–Color Surface–Discharge AC Plasma Display Panels" Japan Display, '89, pp. 206–209.

Nanto et al., "A 15–In.–Diagonal Color Surface Discharge AC–Plasma Display Panel," *Japan Display '89,* pp. 202–209.

Shinoda et al., "Improvement of Luminance and Luminous Efficiency of Surface–Discharge Color ac PDP," *SID 91 Digest,* pp. 724–727.

Yoshikawa et al., "A Full Color AC Plasma Display with 256 Gray Scale," *Japan Display '92,* pp. 605–608.

Kanagu et al., "A 31–in.–Diagonal Full–Color Surface–Discharge ac Plasma Display Panel," *SID 92 Digest,* pp. 713–716.

Shinoda et al., "Invited Address: Development of Technologies for Large–Area Color ac Plasma Display," *SID 93 Digest,* pp. 161–164.

*Primary Examiner*—Dennis-Doon Chow
*Attorney, Agent, or Firm*—Staas & Halsey LLP

[57] ABSTRACT

The present invention provides a flat display including a high-speed arithmetic logic facility so that, even when a data signal for a first line follows immediately after a frame start signal, the display displays an image with stable display quality quickly. For controlling driving signals in a flat display, each sub-frame of a temporally-segmented frame comprises at least an initialization period S1' during which a display screen is initialized, an addressing period S2 during which a plurality of cells are selected and written with display data, and a sustaining discharge period S3 during which the cells which contain display data are discharged so as to emit light for a given period of time. The flat display includes an initialization start time control unit 100 that detects the input of a display start signal $V_{SYNC}$ for one frame, and controls an initialization start time ST of the initialization period S1' so that the ST will precede an instant of input of a frame start signal $V_{SYNC}$.

9 Claims, 13 Drawing Sheets

FLAT DISPLAY

This application is a continuation application of application Ser. No. 08/188,709 filed Jan. 31, 1994 now abandoned.

BACKGROUND OF THE INVENTION

1. Field of the Invention

The present invention relates to a flat display and, more particularly, to a flat display permitting high-speed handling of display data validated immediately after an input of a frame start signal.

2. Description of the Related Art

In recent years, there has been a greater demand for a flat matrix display such as a plasma display (PDP), a liquid crystal display (LCD), or an elecroluminescent (EL) display because of its thin structure, or configuration, in contrast to a CRT. Requests for, especially, a color display are frequent these days.

Flat displays including a plasma display and an electroluminescent (EL) display are thin. Moreover, the flat displays also permit large display screens. The application range and production scale of the flat displays are therefore rapidly expanding.

In general, a flat display utilizes charges accumulated between electrodes and causes a discharge to emit light for display. For better understanding of the general principle of display, the structure and operation of, for example, a plasma display will be briefly described.

Well-known conventional plasma displays (AC type PDP) are a dual-electrode type that uses two electrodes for selective discharge (addressing discharge) and sustaining discharge and a triple-electrode type that uses three electrodes for addressing discharge.

In a plasma display (PDP) for a color display, ultraviolet rays resulting from discharges are used to excite phosphors formed in discharge cells. The phosphors are susceptible to the impact of ions or positive charges induced synchronously with discharge. The above dual-electrode type has a structure that the phosphors directly hit ions. This structure may reduce the service lives of phosphors.

To avoid the deterioration, the color plasma display usually employs the triple-electrode structure based on surface discharge.

The triple-electrode type uses an arrangement in which a third electrode is formed on the substrate on which first and second electrodes for sustaining discharge are arranged or an arrangement in which a third electrode is formed on another substrate opposed to the one on which first and second electrodes are arranged.

In the arrangement in which three electrodes are formed on the same substrate, the third electrode may be placed on or under the other two electrodes for sustaining discharge.

Furthermore, visible light emitted from phosphors may be transmitted or reflected by the phosphors for observation.

The foregoing plasma displays of different types have the same principle. Mention will therefore be made of a flat display in which first and second electrodes for sustaining discharge are formed on a first substrate and a third electrode is formed on a second substrate opposed to the first substrate, by presenting embodiments thereof.

FIG. 6(A) is a schematic plan view showing a configuration of the aforesaid triple-electrode type plasma display (PDP). FIG. 6(B) is a schematic sectional view of one of discharge cells 10 formed in the plasma display shown in FIG. 6(A).

As apparent from FIGS. 6(A) and 6(B), the plasma display comprises two glass substrates 12 and 13. The first substrate 13 has first electrodes (X electrodes) 14 and second electrodes (Y electrodes) 15. The first electrodes 14 and second electrodes 15 serve as sustaining electrodes, lie in parallel with one another, and are shielded with a dielectric layer 18.

A coat 21 made of magnesium oxide (MgO) is formed as a protective coat over the discharge surface that is the dielectric layer 18.

On the surface of the second substrate 12 opposed to the first glass substrate 13, electrodes 16 acting as third electrodes or address electrodes are formed to intersect the sustaining electrodes 14 and 15.

On the address electrodes 16, phosphors 19 each having one of red, green, and blue light-emitting characteristics are placed in discharge spaces 20 each defined by walls 17 formed on the surface of the second substrate 12 on which the address electrodes are arranged.

Discharge cells 10 in the plasma display are separated from one another by partitions.

In a plasma display 1 of the aforesaid example, the first electrodes (X electrodes) 14 and second electrodes (Y electrodes) 15 are lying in parallel with one another and are paired. The second electrodes (Y electrodes) 15 are driven independently, while the first electrodes (X electrodes) 14 act as a common electrode and are driven by a single driver.

FIG. 7 is a schematic block diagram showing peripheral circuits for driving the plasma display shown in FIGS. 6(A) and 6(B). The address electrodes 16 are connected one by one to an address driver 31. During addressing discharge, the address driver 31 applies an address pulse to each address electrode.

The Y electrodes 15 are connected one by one to an Y-electrode scan driver 34.

The scan driver 34 is connected to an Y-electrode common driver 33. For addressing discharge, pulses are generated by the scan driver 34. For sustaining discharge, pulses are generated by the Y-electrode common driver 33, and then applied to the Y electrodes 15 via the Y-electrode scan driver 34.

The X electrodes 14 are connected in common with respect to all display lines on a panel of the flat display.

An X-electrode common driver 32 generates a write pulse and a sustaining pulse, and applies these pulses to the Y electrodes 15 concurrently. These drivers are controlled by a control circuit. The control circuit is controlled with a synchronizing signal which is fed by an external unit.

As is apparent from FIG. 7, the address driver 31 is connected to a display data control unit 36 incorporated in the control circuit 35. The display data control unit 36 inputs a dot clock signal CLOCK and a display data signal DATA, which are display data and fed from an external unit, and outputs address data indicating address electrodes to be selected for each line with a horizontal synchronizing signal $H_{SYNC}$.

The Y-electrode scan driver 34 is connected to a scan driver control unit 39 in a panel drive control unit 38 incorporated in the control circuit 35. In response to a vertical synchronizing signal $V_{SYNC}$ that is a signal instructing the start of scanning one frame and fed by an external unit, and a horizontal signal $H_{SYNC}$ that is a signal instructing the start of scanning one line, the Y-electrode scan driver 34 is driven to select a plurality of Y electrodes 15 in the flat display 1, one by one. Thus, an image of one frame is displayed.

In FIG. 7, Y-DATA denotes scan data that is supplied by the scan driver control unit 39 and used to turn on the Y-electrode scan driver bit by bit. Y-CLOCK denotes a transfer clock pulse for use in turning on the Y-electrode scan driver bit by bit.

Y-STB1 denotes a timing signal for use in turning on the Y-electrode scan driver. Y-STB2 denotes a timing signal for use in turning off the Y-electrode scan driver.

The X-electrode common driver 32 and Y-electrode common driver 33 in this example are connected to a common driver control unit 40 incorporated in the control circuit 35. The X electrodes 14 and Y electrodes 15 are driven all together by reversing polarities of applied voltages alternately. Thus, the aforesaid sustaining discharge is executed.

In FIG. 7, an X-UD signal is supplied by the common driver control unit 40, used to control the on and off states of the X common driver, and the X-UD signal includes voltage signals Vs and Vw. An X-DD signal supplied by the common driver control unit 40 is used to control the on and off states of the X-electrode common driver and the X-DD signal includes a GND level signal.

Likewise, a Y-UD signal supplied by the common driver control unit 40 is used to control the on and off states of the Y-electrode common driver, and the Y-UD signal includes voltage signals Vs and Vw. An Y-DD signal supplied by the common driver control unit 40 is used to control the on and off states of the Y-electrode common driver and the Y-DD signal includes a GND level signal.

Referring to the timing chart of FIG. 8, an example of an image display driving method will be described in conjunction with a conventional triple-electrode type plasma display (PDP) for color display with a single brightness level.

In a prior art, a line-sequential self-erasure addressing mode, in which signals are issued according to the timing shown in FIG. 8, has been adopted for driving.

According to this mode, a sustaining sequence including initialization of a display screen, writing of data, and displaying of data is performed during a pulse spacing of a signal $H_{SYNC}$ for defining a period of scanning one line Data writing is validated only for a selected line.

As apparent from FIG. 8, one $H_{SYNC}$ pulse spacing is segmented into a selected line writing period S1, a self-erasure addressing period S2, and a sustaining discharge period S3. Electric fields are induced from X electrodes associated with a selected line to Y electrodes associated therewith during the selected line writing period S1 in each $H_{SYNC}$ pulse spacing. Thus, sustaining discharge is carried out. Cells that were lit for a previous frame discharge during the sustaining discharge period, while cells that were not lit do not light. Sustaining discharge is performed again to induce larger electric fields from the X electrodes to the Y electrodes. Writing is then performed to light all the cells associated with the selected line. Thus, all the cells associated with the selected line light and hold internal electric fields resulting from wall charge therein. Consequently, a whole screen is initialized uniformly. Electric fields are then induced from the Y electrodes to X electrodes, whereby a sustaining discharge is effected to light all the cells.

During the self-erasure addressing period S2, the address electrodes associated with a selected line are supplied with address pulses. Display data are then written. This writing is accomplished by allowing the cells, which should not be displayed, to self-erase the internal electric fields.

In other words, a sustaining discharge achieved between X and Y electrodes, and generation of address pulses are stopped simultaneously so that the X and Y electrodes have the same voltage to eliminate external electric fields. When the address electrodes and Y electrodes are energized to induce inverse electric fields between them, self-erasure discharge occurs due to internal electric fields. Cells that are not written will not light during a succeeding sustaining discharge period S3.

Sustaining discharge is repeated between the X and Y electrodes until the line associated with the X and Y electrodes is selected for the next frame. Cells, which must be displayed, are kept lit. Cells, which should not be displayed, are not lit.

The aforesaid conventional mechanism of self-erasure in cells is based on internal electric fields in the cells. The magnitudes of the internal electric fields must therefore be determined somewhat precisely. A magnitude of an internal electric field in a cell or an amount of wall charge is greatly dependent on the state of the cell that is discharging to emit light. There are however difficulties in manufacturing a fully uniform display panel. The difficulties intensify with an increase in area of a display panel.

When initialization is executed to write data for one line, there is a difference in wall charge between cells that were lit for a previous frame and cells that were not lit. Moreover, some cells induce externally-applied electric fields whereas other cells induce internal electric fields. These facts pose a problem that self-erasure due to internal electric fields causes an erasure error of insufficient erasure and the erasure error triggers a write error. The write error eventually degrades the display quality.

To solve the above problem, the present applicant has proposed a driving method based on a batch writing/batch erasure/line-sequential addressing mode.

The driving method based on a batch writing/batch erasure/line-sequential addressing mode is shown schematically in FIG. 9 and will be described briefly.

In FIG. 9, one screen is displayed in units of one frame. In this driving method, driving is performed differently among an all-line batch writing/erasure period S1', an addressing period S2 during which all lines are scanned line by line and thus data are written line-sequentially, and a sustaining discharge period S3 during which a whole screen is displayed. This method is thought to enable stable addressing and writing.

Even in this method, a period during which batch writing and erasure is executed for all lines is required after a frame start control signal is sent until display data are written. When sufficient time is not ensured after a signal is sent from a host until data are transmitted, the method is inapplicable.

In the prior art, after a frame start control signal $V_{SYNC}$ is received, a time interval for initialization is required to ensure a period during which several pulses in a horizontal synchronizing signal $H_{SYNC}$ are input.

When a data signal for the first line follows immediately after the frame start control signal $V_{SYNC}$, unless a frame memory or other data storage means is provided, data cannot be processed.

In the prior art, specification or standard designs are previously determined, and during a given period, corresponding to a period starting from the time when a given frame start control signal $V_{SYNC}$ is received to the time when several pulses of a horizontal synchronizing signals $H_{SYNC}$ are input, the input of a display data signal is disabled. A signal sent from a host cannot always be put to use.

SUMMARY OF THE INVENTION

Accordingly, an object of the percent invention is to solve the problems in the prior art and to provide a flat display having a high-speed arithmetic logic facility that even when a data signal for the first line follows immediately after a frame start signal, an image can be displayed quickly with stable display quality.

To accomplish the foregoing object, the present invention adopts a technical configuration described below. That is to say, at least two substrates each having electrodes on the surface thereof are arranged closely so that the electrodes intersect and face mutually. Phosphors are interposed between the substrates. A plurality of intersections formed between the electrodes construct cells associated with pixels. Each of the cells has a capability of a memory for storing a given amount of charge according to a voltage applied to an electrode in the cell and also has an ability of discharge and light emission. In a flat display having this structure, one frame to be displayed on the flat display is segmented temporally into a plurality of sub-frames corresponding to scanning lines. Each of the sub-frames is temporally composed at least of an initialization period during which a display screen is initialized, an addressing period during which a plurality of cells are selected to write display data, and a sustaining discharge period during which the cells that are written display data are discharged so as to emit light for a given period of time. The flat display further comprises an initialization start time control means that detects the input of a display start signal for one frame, and controls the initialization start time of the initialization period so that the start time will precede the instant of input of the frame start control signal $V_{SYNC}$.

A flat display according to the present invention adopts the aforesaid technological configuration to solve the aforesaid problems of the prior art. Owing to the configuration, a required display start signal $V_{SNEW}$ can be produced in the flat display to uniquely and actively ensure a period for initialization after a frame start control signal $V_{SYNC}$ is received from an external unit until the next frame start control signal $V_{SYNC}$ is received from the external unit. Moreover, the display start signal $V_{SNEW}$ can be issued at any time instant to precede the frame start control signal $V_{SYNC}$, Initialization starting can therefore be executed for the frame earlier than that in a conventional flat display. Even when a data signal for the first line is transmitted immediately after a frame start control signal $V_{SYNC}$, an image can be displayed quickly with stable display quality. Furthermore, the flat display can receive an image input signal from any host.

DESCRIPTION OF THE PREFERRED EMBODIMENTS

An example or the first embodiment of a flat display according to the present invention will be described in detail with reference to the drawings.

Figure 1A:
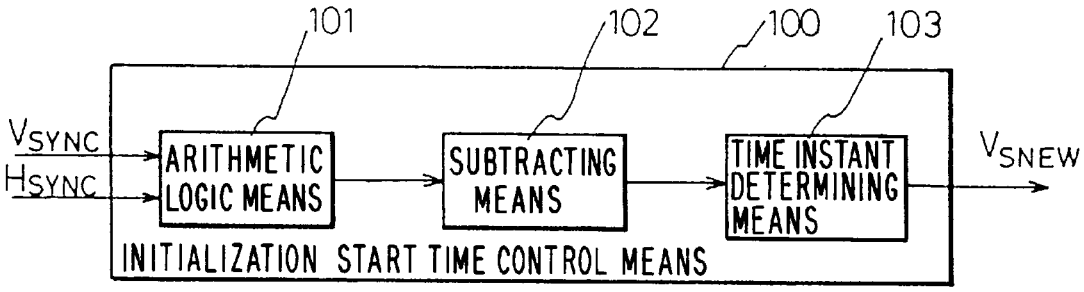
FIG. 1(A) is a block diagram for explaining the principle of a control means in a flat display according to the present invention.
Figure 6A:
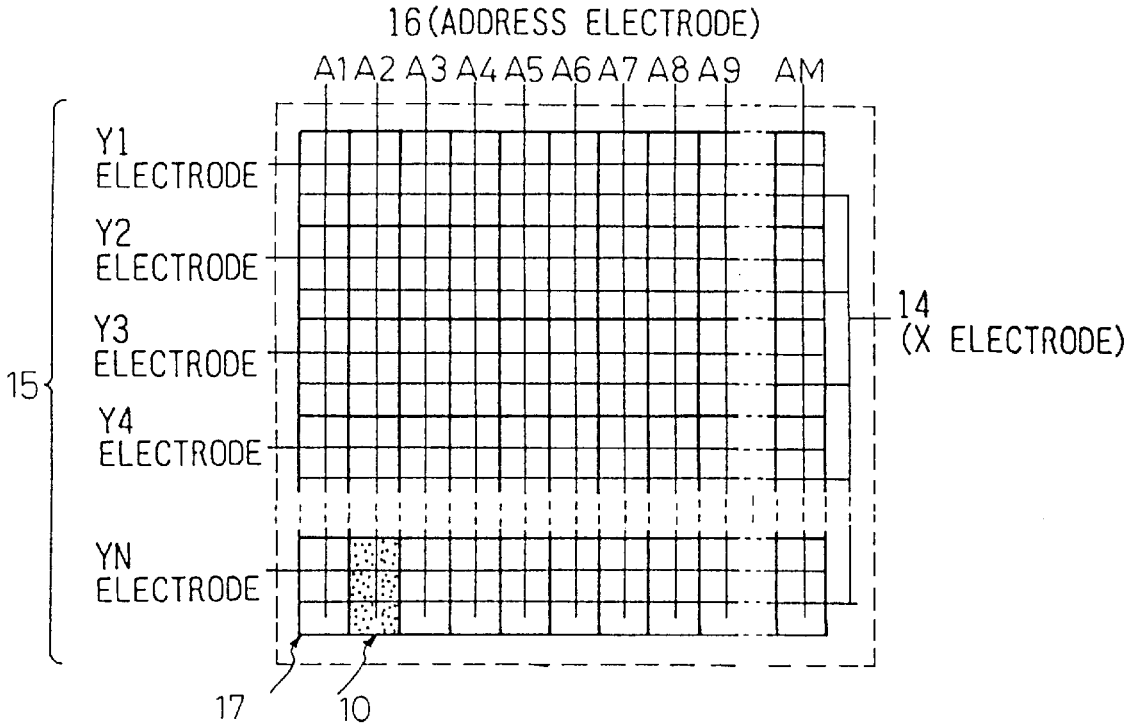
Fig.6(A) PRIOR ART
FIG. 6(A) is a plan view for explaining an example of a configuration of a flat display.
Figure 6B:
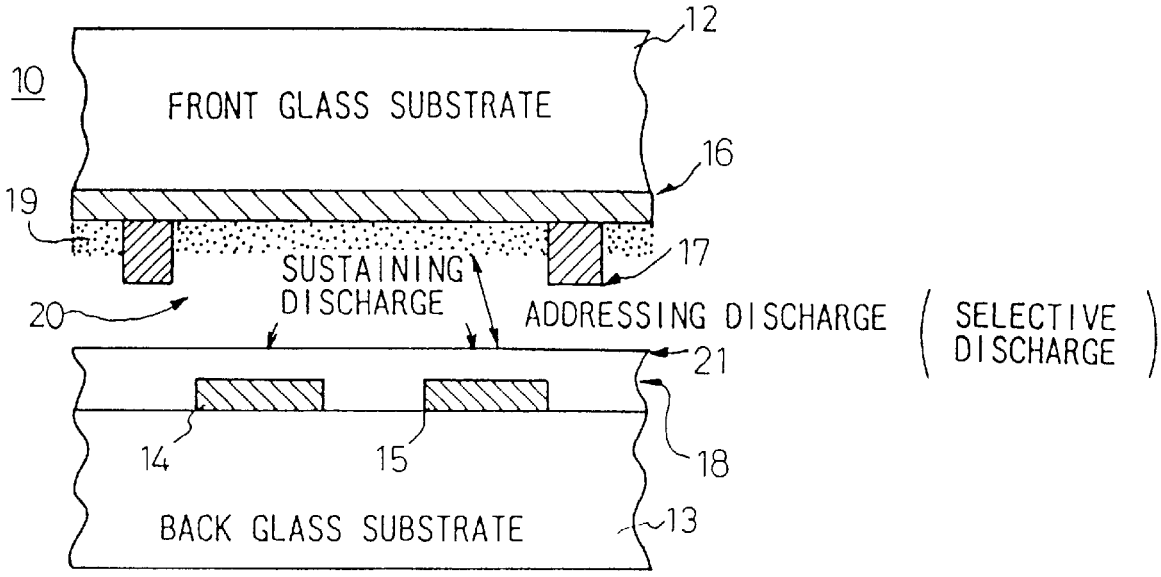
Fig.6(B) PRIOR ART
FIG. 6(B) is a sectional view showing an example of a structure of a cell in the flat display.
Figure 7:
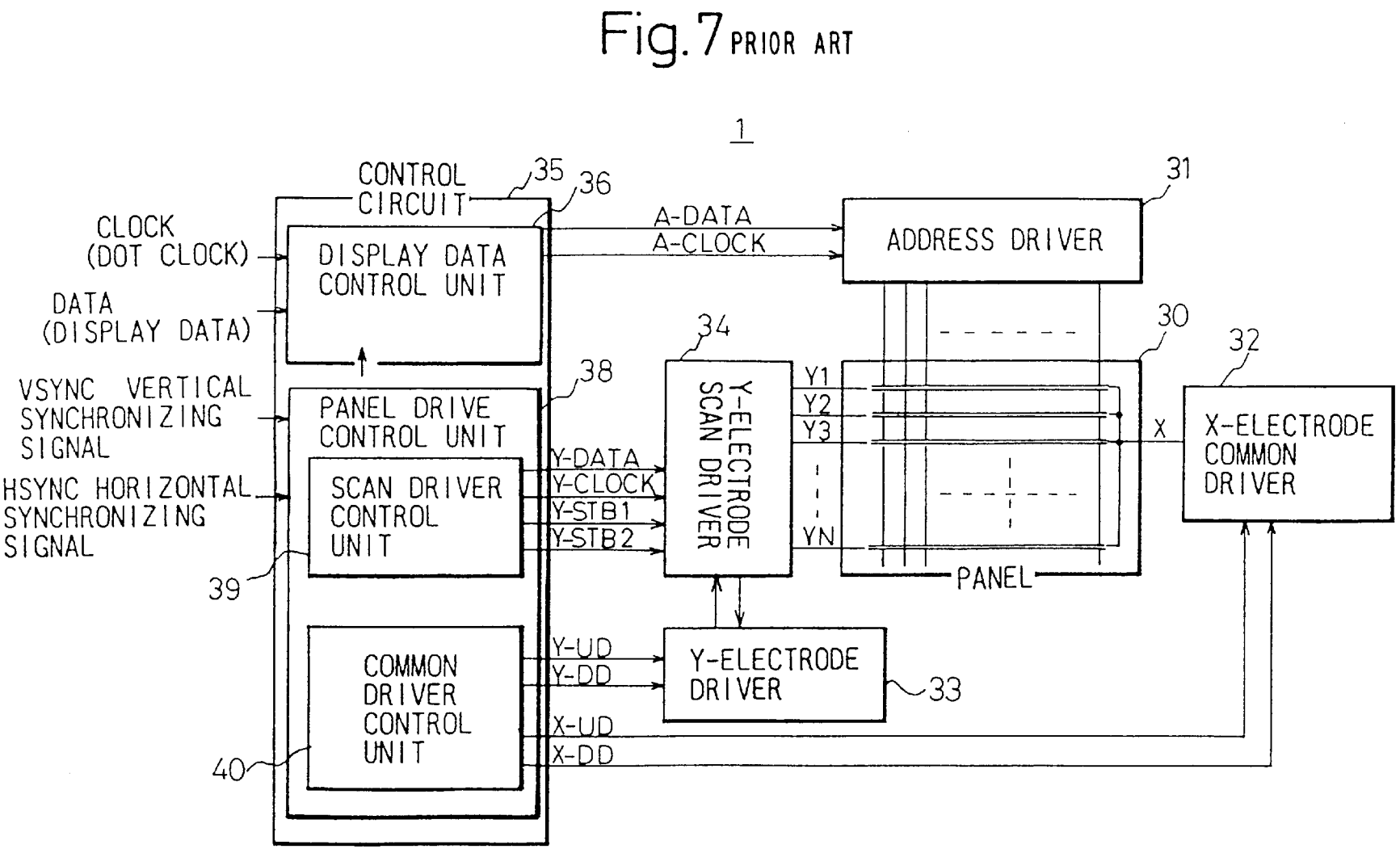
Fig. 7 PRIOR ART
FIG. 7 is a block diagram showing an example of a configuration of a driving means in a conventional flat display.
Figure 8:
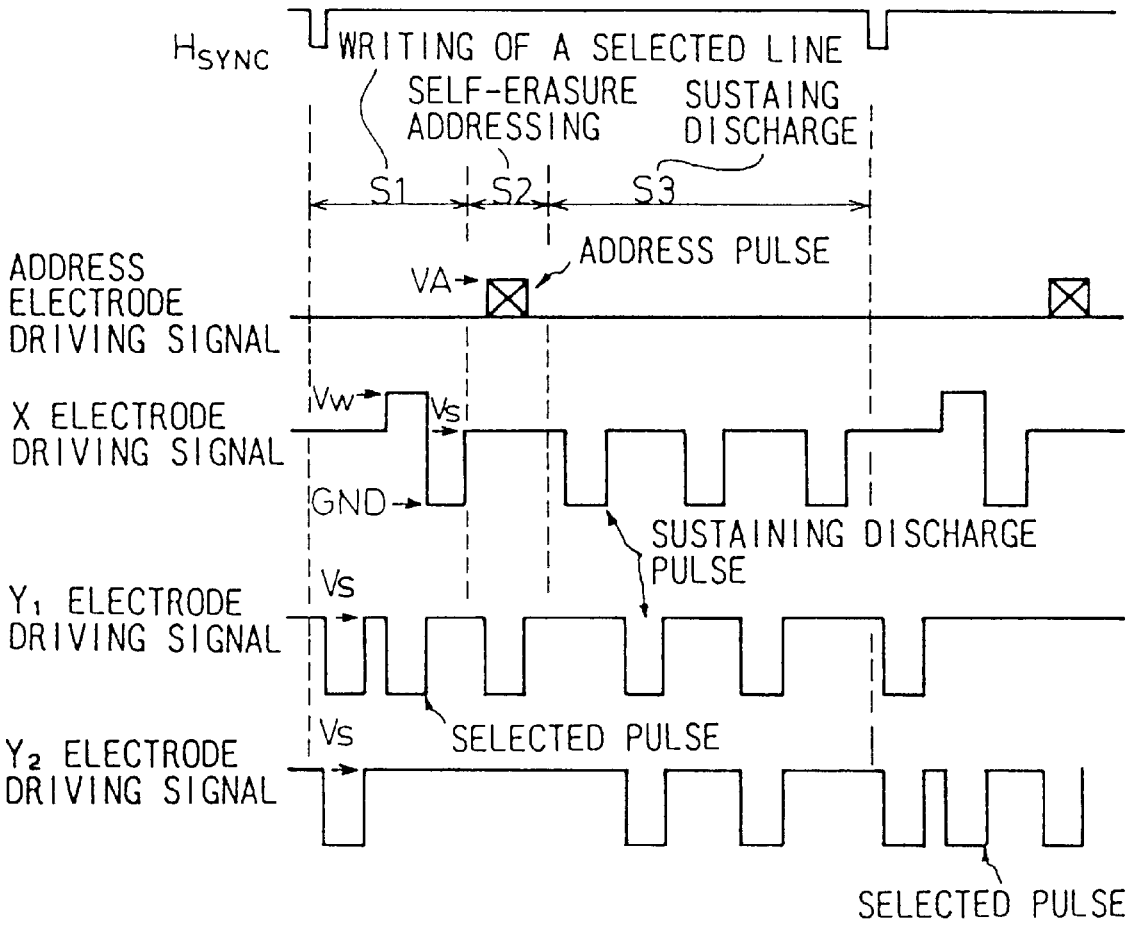
Fig. 8 PRIOR ART
FIG. 8 is a timing chart showing drive timing in the conventional flat display.
Figure 9:
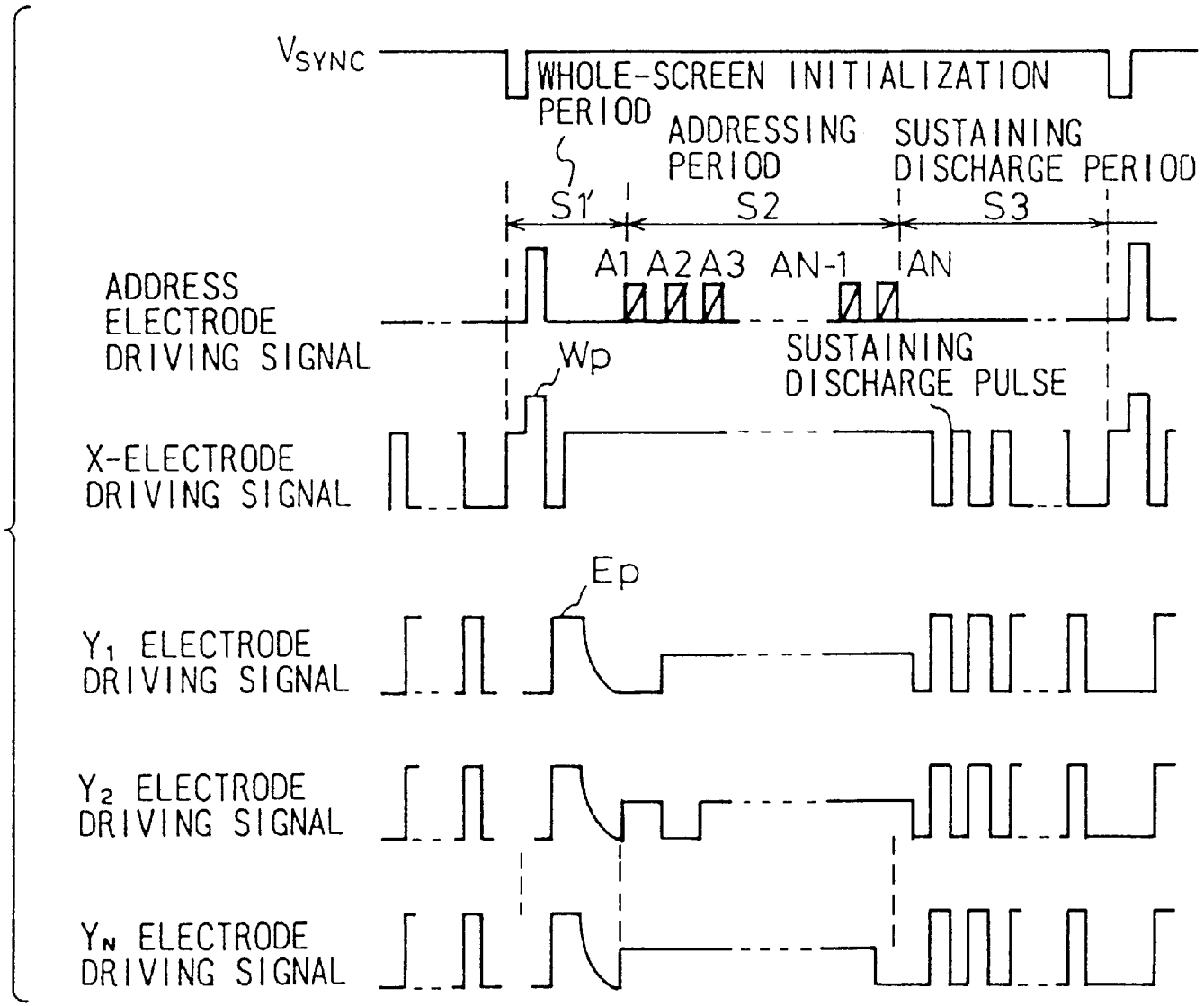
Fig. 9 PRIOR ART
FIG. 9 is a timing chart showing drive timing in the conventional flat display.

FIG. 1(A) is a block diagram showing a configuration of an example of an initialization start time control circuit 100 that is a major component of the flat display according to the present invention. More particularly, as shown in FIG. 6, at least two substrates 12 and 13 each having electrodes on the surface thereof are arranged closely so that the electrodes intersect and face mutually. Phosphors 19 are interposed between the substrates 12 and 13. A plurality of intersections formed between the electrodes construct cells 10. Each of the cells 10 has a capability of a memory for storing a given amount of charge according to a voltage applied to an electrode in the cell and also has an ability of discharge and light emission. In the flat display having this structure, one frame to be displayed is temporally segmented into a plurality of sub-frames corresponding to scanning lines. For controlling driving signals in the flat display, each sub-frame is temporally composed at least of an initialization period S1 during which a display screen is initialized, an addressing period S2 during which a plurality of cells are selected to write display data, and a sustaining discharge period S3 during which the cells that are written display data are discharged so as to emit light for a given period of time. The flat display having the above configuration further comprises the initialization start time control circuit 100 shown in FIG. 1(A) that detects the input of a frame start control signal $V_{SYNC}$ for one frame and controls an initialization start time instant ST of the initialization period S1' of the frame so that the time instant ST will precede the time instant of input of the frame start control signal $V_{SYNC}$.

The flat display according to the present invention may be of a type that uses three electrodes to execute image display drive or a triple-electrode color display type.

In the flat display according to the present invention, the initialization period S1' in one frame should preferably be a period during which given data are simultaneously written or erased in or from cells so as to initialize a display screen.

In the flat display according to the present invention, the initialization start time control circuit 100 is preferably designed to detect the input of a frame start control signal $V_{SYNC}$ for one frame, and to control the initialization start time instant ST of the initialization period S1' in the first sub-frame so that the time instant ST will precede the time instant of input of the frame start control signal $V_{SYNC}$ by a time interval comparable to a predetermined number of pulses in the horizontal synchronizing signal $H_{SYNC}$.

An example of a configuration of the initialization start time control circuit 100 according to the present invention shown in FIG. 1(A), and the operation thereof will be described with reference to FIG. 1(B).

Preferred major facilities included in the initialization start time control circuit 100 are an arithmetic logic circuit 101 for calculating a pulse spacing of a frame start signal $V_{SYNC}$ for one frame, a subtracting circuit 102 for subtracting a time interval comparable to (i.e., defined by) a predetermined number of $H_{SYNC}$ pulses from the pulse spacing of the frame start control signal $V_{SYNC}$ for each frame, and a circuit 103 for determining a time instant, at which the time interval calculated by the subtracting circuit has passed since the time instant of generation of the display start signal $V_{SNEW}$ for one frame, as an initialization start time instant.

Figure 1B:
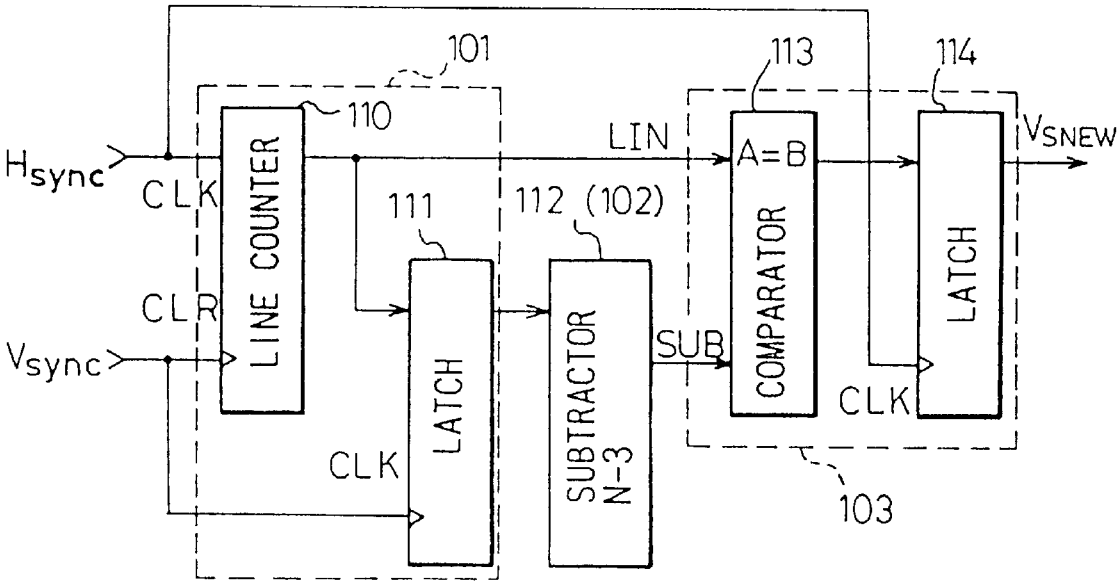
FIG. 1(B) is a block diagram for explaining a configuration of the control means more particularly.

FIG. 1(B) is a block diagram showing a configuration and a principle of the initialization start control circuit 100 in the flat display according to the present invention. Reference numeral 110 denotes a line counter for counting the number of horizontal scanning lines ($H_{SYNC}$) during a pulse interval, or period, of a frame start control signal $V_{SYNC}$ fed by a host. Reference numeral 111 denotes a latch for holding the data provided by the line counter 110 for the next $V_{SYNC}$ pulse spacing. Reference numeral 112 denotes a subtractor for subtracting a period required for initialization (herein, a period comparable to, or defined by, three $H_{SYNC}$ pulses) from the data stored in the latch. Reference numeral 113 denotes a comparator for inputting an output signal SUB of the subtractor 112 and an output signal LIN of the line counter 110. When the output of the subtractor 112 agrees with the output of the line counter 110, that is, SUB=LINE is established, the comparator 113 outputs a low-level signal.

Reference numeral 114 denotes a latch for holding the output of the comparator 113 in units of an $H_{SYNC}$ pulse spacing. The latch 114 produces a new $V_{SNEW}$ signal in response to a clock pulse CLK so that initialization is performed before addressing.

The $V_{SNEW}$ signal is used as a reference to control the operations of the internal circuitry.

In the initialization start time control circuit 100 in the flat display according to the present invention, first, as described above, the $V_{SYNC}$ and $H_{SYNC}$ signals are input to the line counter 110 simultaneously. The $V_{SYNC}$ signal is used as a clear signal. In response to the $V_{SYNC}$ signal, the count value in the line counter 110 is reset to zero. The number of $H_{SYNC}$ pulses is then counted until the next $V_{SYNC}$ signal is input.

In response to the clear signal $V_{SYNC}$, the number of $H_{SYNC}$ pulses, N, is stored as a count value in the latch 111.

A host outputs the $V_{SYNC}$ and $H_{SYNC}$ signals constantly. Once $H_{SYNC}$ pulses for one frame are stored, the number of $H_{SYNC}$ pulses during a pulse spacing of the $V_{SYNC}$ signal is unchanged and constant.

The line counter 110 and latch 111 shown in FIG. 1(B) correspond to the arithmetic logic unit or circuit 101 for calculating a pulse spacing of a frame start control signal $V_{SYNC}$ for one frame shown in FIG. 1(A).

Figure 3:
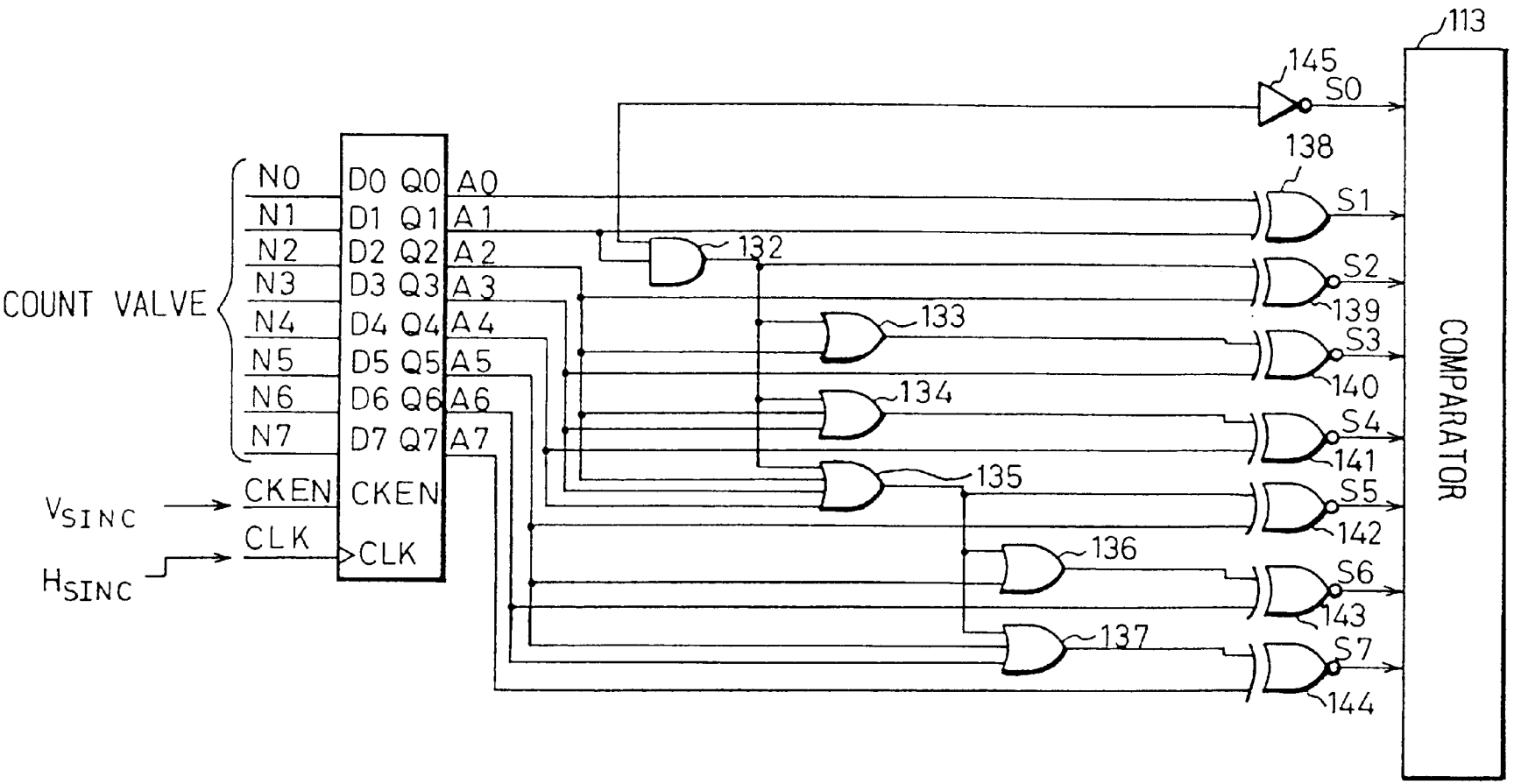
FIG. 3 is a block diagram for explaining a configuration of an example of a subtractor according to the present invention.

The subtractor 112 subtracts a predetermined given number, for example, the number of $H_{SYNC}$ pulses, from a count value N or a pulse spacing of the $V_{SYNC}$ signal stored in the latch 111. In the example of FIG. 1(B), 3 is set as the given number. That is to say, a time interval comparable to the time required for producing three $H_{SYNC}$ pulses is subtracted from the count value N. In short, subtraction (N−3) is executed.

The subtractor 112 corresponds to the subtracting means 102 shown in FIG. 1(A).

The comparator 113 compares the (N−3) output of the subtractor 113 or the result of subtraction (N−3) with the number of $H_{SYNC}$ pulses provided by the line counter 110. When they agree with each other, the comparator 113 outputs a low-level signal, and feeds the low-level signal to the second latch 114. Eventually, the aforesaid display start signal $V_{SNEW}$ for one frame is output in response to the $H_{SYNC}$ signal.

In the flat display according to the present invention, the subtrahend set in the subtractor 112 is not limited to 3 but may be any other numerical value.

In the flat display according to the present invention, the waves (i.e., waveforms) of signals for driving address electrodes, X electrodes, and Y electrodes are stored in a ROM. The addresses in the ROM in which the waves are stored are associated with initialization period of different lengths, addressing periods of different lengths, and sustaining discharge periods of different lengths. By reading data from a specific address at any required time instant, optimal control signals are issued to drivers.

According to the present invention, batch initialization is executed for one frame, at an initialization start time instant preceding a given time instant of input of a $V_{SYNC}$ signal. More particularly, a spacing between adjoining $V_{SYNC}$ pulses is measured in the first process. Thus, a pulse spacing of the $V_{SYNC}$ signal at the initialization start time instant is checked and determined.

In the next process, a period during which a given number of $H_{SYNC}$ pulses occur is subtracted from the measured spacing between adjoining $V_{SYNC}$ pulses (for example, N−3). An instant preceding the instant of occurrence of a next successive $V_{SYNC}$ signal is determined as the instant at which batch initialization is to be executed.

Figure 2:
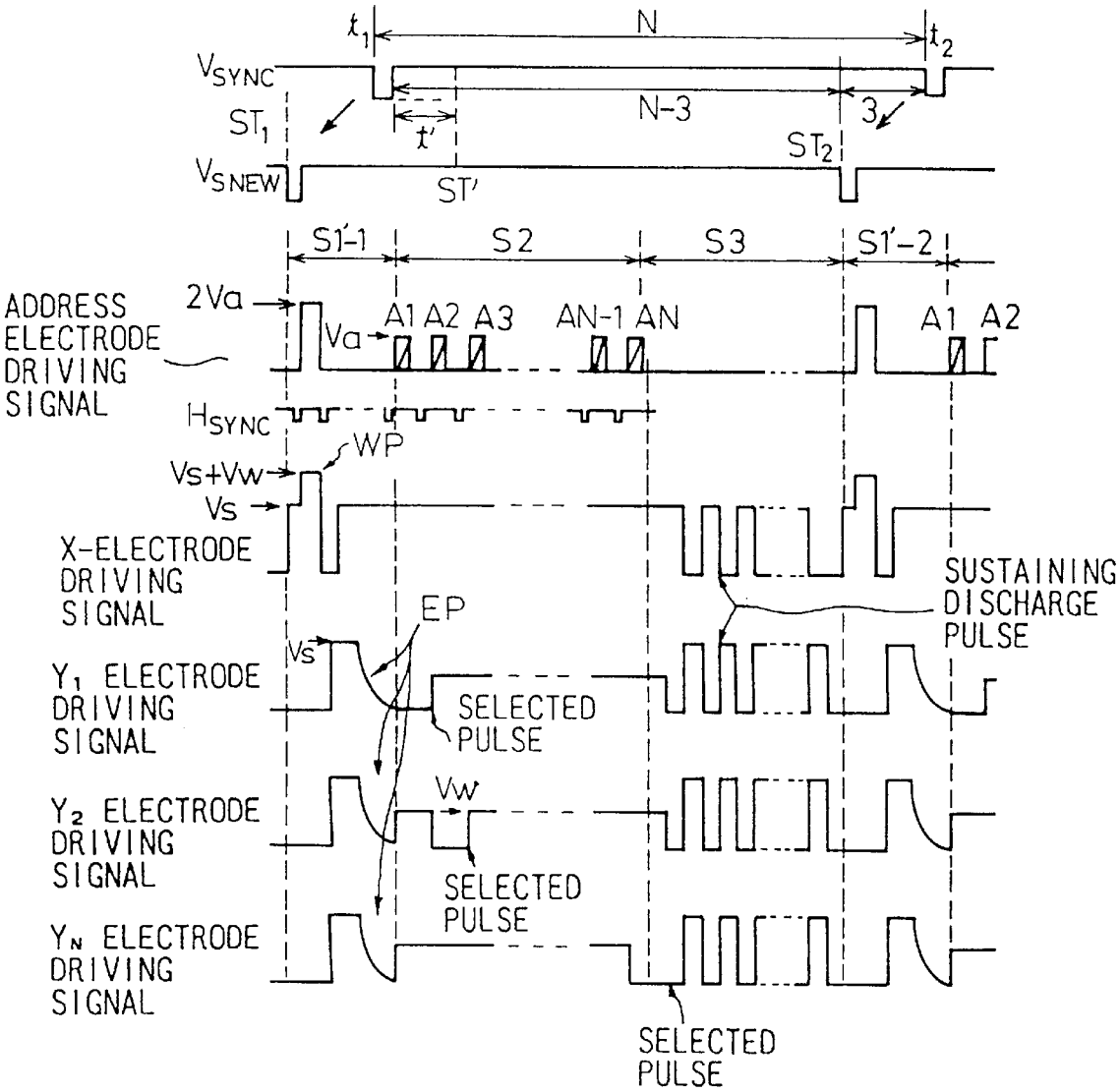
FIG. 2 is a timing chart for explaining operational timing in the flat display according to the present invention.

FIG. 2 shows the drive timing of outputting a $V_{SNEW}$ signal in the flat display having the aforesaid configuration.

In FIG. 2, S1' denotes a batch writing/erasure period for initialization. S2 denotes an addressing period for writing display data. S3 denotes a sustaining discharge period for displaying an image according to written data. $V_{SYNC}$ denotes a frame start control signal for defining the start of a frame. At the trailing edge of the $V_{SYNC}$ signal, frame scanning starts.

As apparent from FIG. 2, in the flat display according to the present invention, one frame to be displayed is segmented temporally into a plurality of sub-frames corresponding to scanning lines. Each of the sub-frames comprises at least a whole-screen initialization period S1' during which a plurality of cells 10 are selected and written data, an addressing period S2 during which given cells associated with a given selected line are written display data, and a sustaining discharge period S3 during which the cells 10 that are written with display data are discharged so as to emit light for a given period of time.

In FIG. 2, a $V_{SYNC}$ signal, i.e., a frame start control signal for a given frame, is input at time instants t1 and t2. According to the prior art, the batch writing/erasure period S1' is started at the time instant at which the $V_{SYNC}$ signal is input, and display data transmission is started at a time instant ST' succeeding the time instant of input of the $V_{SYNC}$ signal by a delay of a given time interval t' defined in the specifications. According to the present invention, batch writing/erasure is started at a time instant ST, which is calculated by subtracting, for example, 3 from a spacing N between adjoining $V_{SYNC}$ pulses, before the time instant at which the $V_{SYNC}$ signal is input.

During the batch writing/erasure period S1' according to the present invention, a write pulse WP is applied to all the cells, and then a batch erasure pulse is applied to the Y electrodes. As shown in FIG. 2, the batch erasure pulse EP does not have a steep trailing edge but a skirt-like trailing edge. This is because the plurality of cells differ from one another in terms of an erasure speed. Assuming that a batch erasure pulse EP having a steep trailing edge is employed, the cells capable of completing erasure shortly may finish off discharge quickly but the cells that have not completed discharge may remain undischarged. This makes it impossible to complete initialization perfectly. That is why the pulse having the skirt-like trailing edge is employed.

As mentioned above, according to the present invention, the $V_{SYNC}$ signal is generated as described above. Thereafter, the batch writing/erasure is executed during the period S1' in the same manner as the one according to the prior art. Addressing and sustaining discharge are then executed for each line during the periods S2 and S3.

FIG. 3 is a block diagram showing a configuration of an example of the subtracting circuit 102 or 112 in the flat display according to the present invention. In FIG. 3, the subtracting circuit 102 or 112 is composed primarily of a combination of OR gates.

In FIG. 3, count values N0 to N7 are fed to input ports D0 to D7 of an arithmetic logic unit 131 including the line counter 110 and latch 111. Signals $V_{SYNC}$ and $H_{SYNC}$ are fed to input ports CKEN and CLK at the same time.

An AND gate 132, dual-port OR gates 133 and 136, triple-port OR gates 134 and 137, a quadruple-port OR gate 135, an exclusive OR gate 138, exclusive NOR gates 139 to 144, and an inverter 145 are connected to output ports of the arithmetic logic unit 131 as shown in FIG. 3. In this circuitry, as described previously, the number of given $H_{SYNC}$ pulses, for example, 3, is subtracted from the total number of $H_{SYNC}$ pulses occurring during a pulse spacing of the $V_{SYNC}$ signal. That is to say, N−3 is calculated.

Output terminals S0 to S7 of the subtracting means are connected to the input terminals of the comparing means 113.

Figure 4:
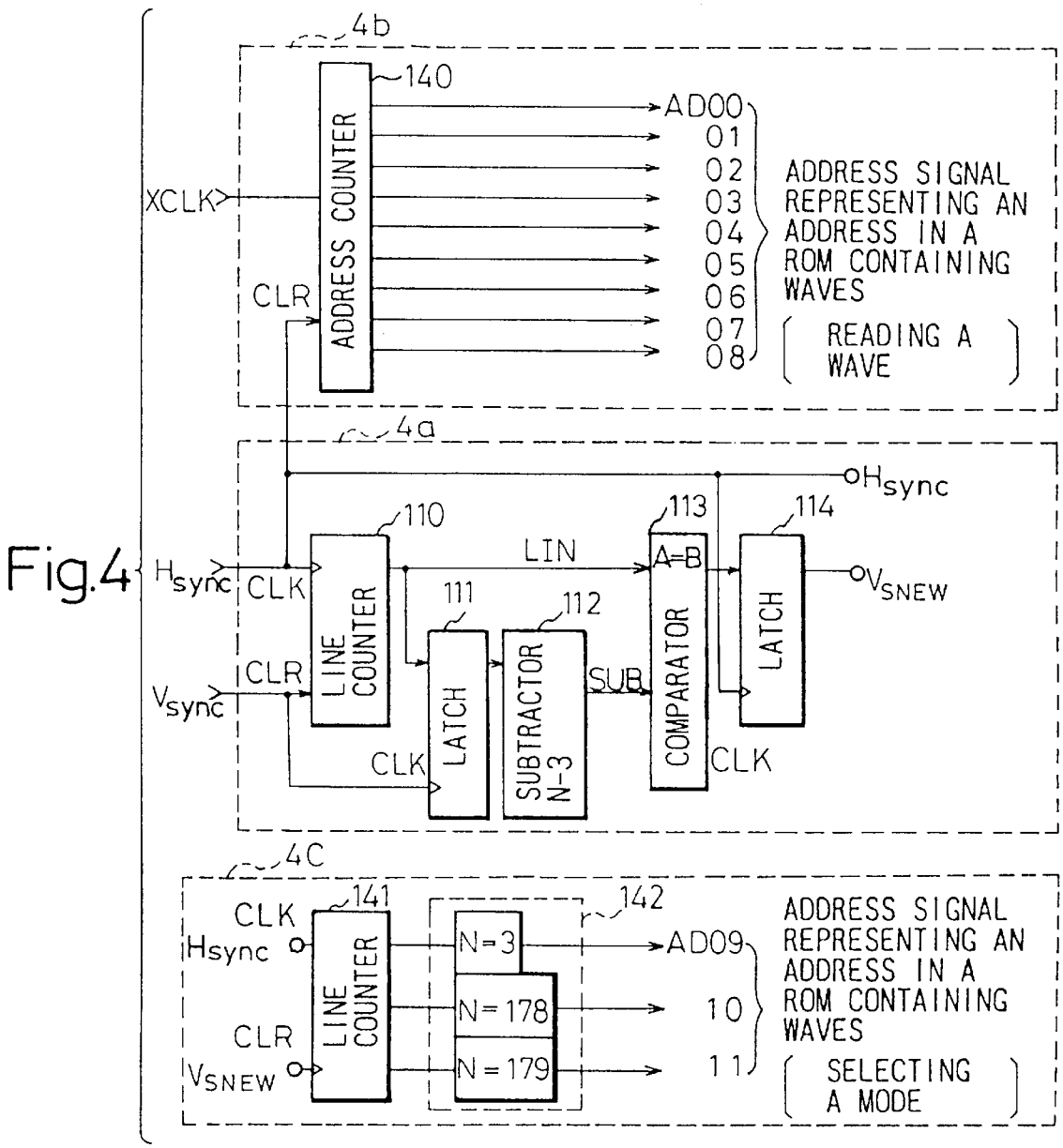
FIG. 4 is a block diagram for explaining a configuration of an example of a flat display according to the present invention.

FIG. 4 is a block diagram showing an example of a drive control circuit in a flat display having the foregoing subtracting circuit.

FIG. 4 shows a timing control unit for a triple-electrode type color plasma display that is an embodiment of the present invention. In FIG. 4, components identical to those in FIG. 1 are assigned the same reference numerals.

In FIG. 4, reference numeral **4*a*** denotes a circuit for producing a display start signal $V_{SNEW}$ for internal drive using external signals $V_{SYNC}$ and $H_{SYNC}$ sent from a host. The operations of the circuit have already been described.

Reference numeral **4*b* denotes a circuit that comprises an address counter 140 and produces a signal representing an address in a ROM containing waveforms at intervals of an $H_{SYNC}$ pulse spacing. The circuit 4*b*** counts XCLK clocks to identify an address, and then outputs the address. The count value is cleared at intervals of an $H_{SYNC}$ pulse spacing.

The address counter 140 counts the number of reference pulses during an $H_{SYNC}$ pulse spacing, and then outputs any of address signals AD00 to AD0B coincident with the count value.

With the address signals, a plurality of lines constituting one frame are selected sequentially and writing is executed.

A circuit **4*c* comprises a line counter 141 that produces address signals for use in controlling modes defined with waves of driving signals at intervals of a pulse spacing of an internal display start signal $V_{SNEW}$ produced by the circuit 4*a*. The line counter 141** comprises a counter for counting the number of $H_{SYNC}$ pulses and gates constituting a decoder.

The control circuit **4*a* includes a mode select circuit 142 which selects a given mode according to a count value provided by the line counter 141**.

For example, as shown in FIG. 4, when the counted number of $H_{SYNC}$ pulses is 3, the mode select circuit 142 outputs a control signal AD09 to start the addressing period S2.

In the flat display according to the present invention, when a $V_{SNEW}$ display start signal is generated internally, the batch writing/erasure period S1' is started immediately. When the counted number of $H_{SYNC}$ Pulses becomes 3, the addressing period S2 is started.

When the counted number of $H_{SYNC}$ pulses, N, is 178, the mode select circuit 142 outputs a control signal AD10 instructing the termination of the addressing period S2.

In this embodiment, the number of lines constituting one frame is set to 176. Since the batch writing/erasure period S1' requires a time interval comparable to three $H_{SYNC}$ pulses, the number of lines scanned by the time instant of termination of addressing is 179.

However, in the flat display according to the present invention, if the counted number of $H_{SYNC}$ pulses varies due to, for example, noise, although the arithmetic logic circuit is still handling the addressing period S2, the sustaining discharge period S3 may be started. On the contrary, although the sustaining discharge period S3 has already started, the arithmetic logic circuit may be still handling the addressing period S2. To avoid these incorrect operations of the arithmetic logic circuit, it is preferred in this embodiment of the present invention to provide such a mode that when the counted number of $H_{SYNC}$ pulses becomes a check point value, for example, 179, a control signal AD11 is output so that the next counting will not cause the addressing period to extend but allow the sustaining discharge period S3 to start without fail.

In the aforesaid embodiment of the present invention, another mode can also be provided: as further described later, the number of sustaining discharge cycles occurring during the sustaining discharge period S3 is varied to change the brightness for displaying an image.

Figure 5:
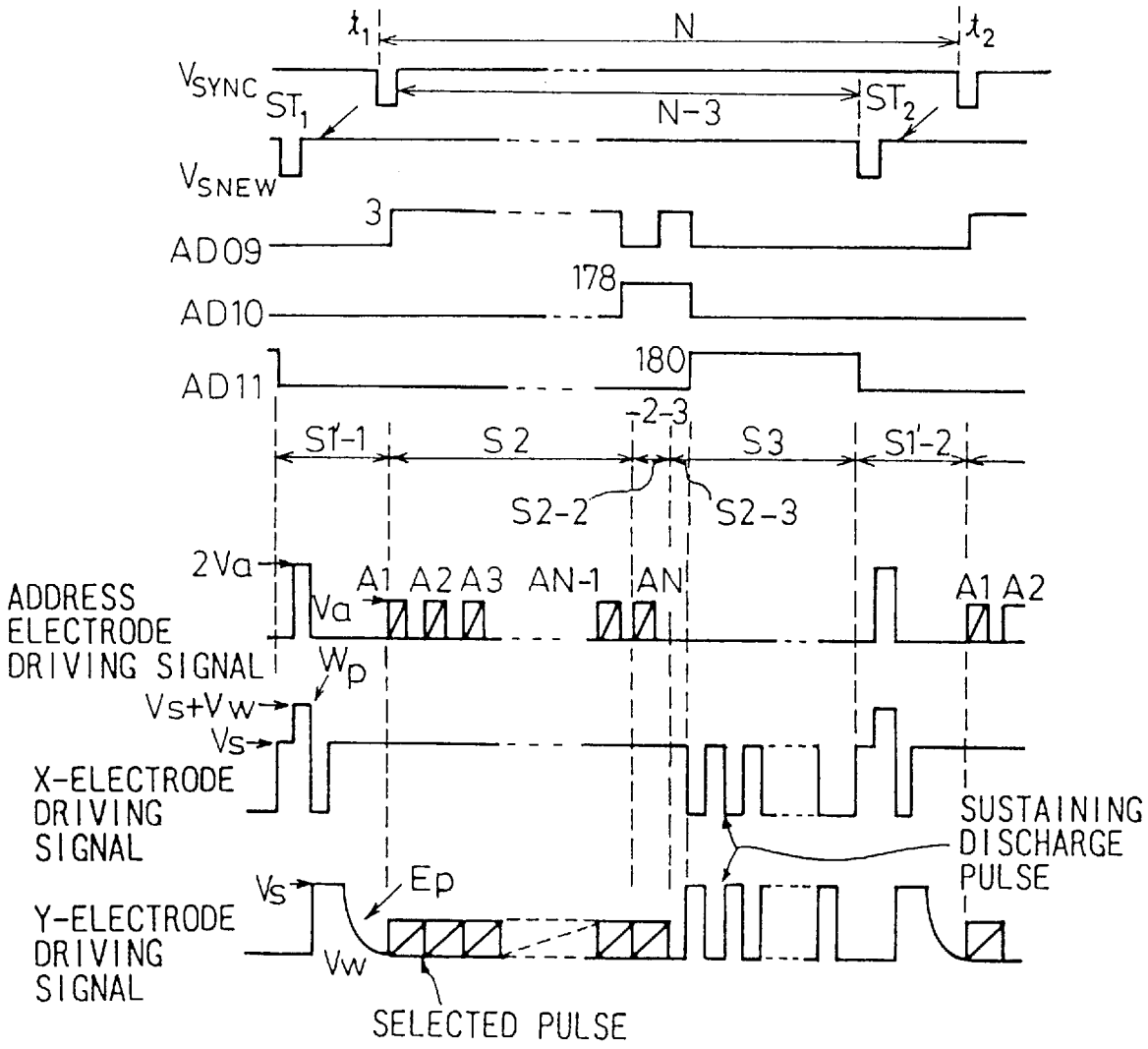
FIG. 5 is a timing chart showing waves of driving signals in the flat display shown in FIG. 4.

FIG. 5 shows operational timing in the flat display according to the present invention.

A display start signal $V_{SNEW}$ for internal circuits is produced at a time instant that precedes a time instant, at which a $V_{SYNC}$ frame start control signal is fed from a host, by a period required for initialization of a flat display such as a plasma display (PDP), for example, a period comparable to three $H_{SYNC}$ pulses. When the display start signal $V_{SNEW}$ is produced, driving is started.

When three $H_{SYNC}$ pulses have been counted after the input of the $V_{SNEW}$ signal, initialization terminates. A ROM address signal AD09 is then driven high to address a storage area in the ROM in which a wave for an addressing period is stored. Thus, a write addressing period S1'-1 starts. Display data sent from a host are then written sequentially in cells associated with each line.

In this embodiment, the start of an addressing period determines the timing of driving a flat display such as a plasma display (PDP) offering 176 display lines. The addressing period is therefore repeated 176 times. However, the last addressing period is provided to indicate an address in another data storage. This is intended to eliminate a possibility that an excessive number of address signals may be fed to the ROM. Specifically, even when many reference clocks XCLK are counted, a certain address is specified. It is an address signal AD10 that specifies the certain address. When an addressing period terminates, sustaining discharge is executed between X and Y electrodes to move data, which have been written in address electrodes and Y electrodes, into areas between X and Y electrodes. This is a write addressing period S1'-3. An address signal AD11 is issued to access a storage area in which a wave for a sustaining discharge period is stored. The sustaining discharge period is then started, whereby the data written for a whole screen are displayed. The sustaining discharge period lasts until the next $V_{SNEW}$ signal is input. The initialization period then restarts.

Next, another example, or the second embodiment, of a flat display according to the present invention will be described with reference to FIGS. 11 and 12.

The primary configuration of the second embodiment is identical to that of the first embodiment. This embodiment further includes a mode in which the brightness of a screen is varied by changing the number of sustaining discharge cycles occurring during a sustaining discharge period for each line or frame.

In the aforesaid first embodiment, after an addressing period terminates, a sustaining discharge period is repeated until the next $V_{SNEW}$ signal is input. By changing the number of sustaining discharge cycles occurring during a sustaining discharge period, the brightness of a display screen in a flat display such as a plasma display can be varied.

For this variation, brightness setting switches are installed additionally and turned on selectively and externally. A minimum unit of a waveform of a driving signal is an $H_{SYNC}$ pulse. For example, four values are specified as the number of sustain discharge cycles occurring during a $H_{SYNC}$ pulse spacing, and stored in four storage areas for a sustaining discharge period. Two addresses (for example, BD00 and BD01) are created in the ROM as shown in FIG. 11. Thus, brightness levels of an image can be changed using the external brightness switches.

Figure 10:
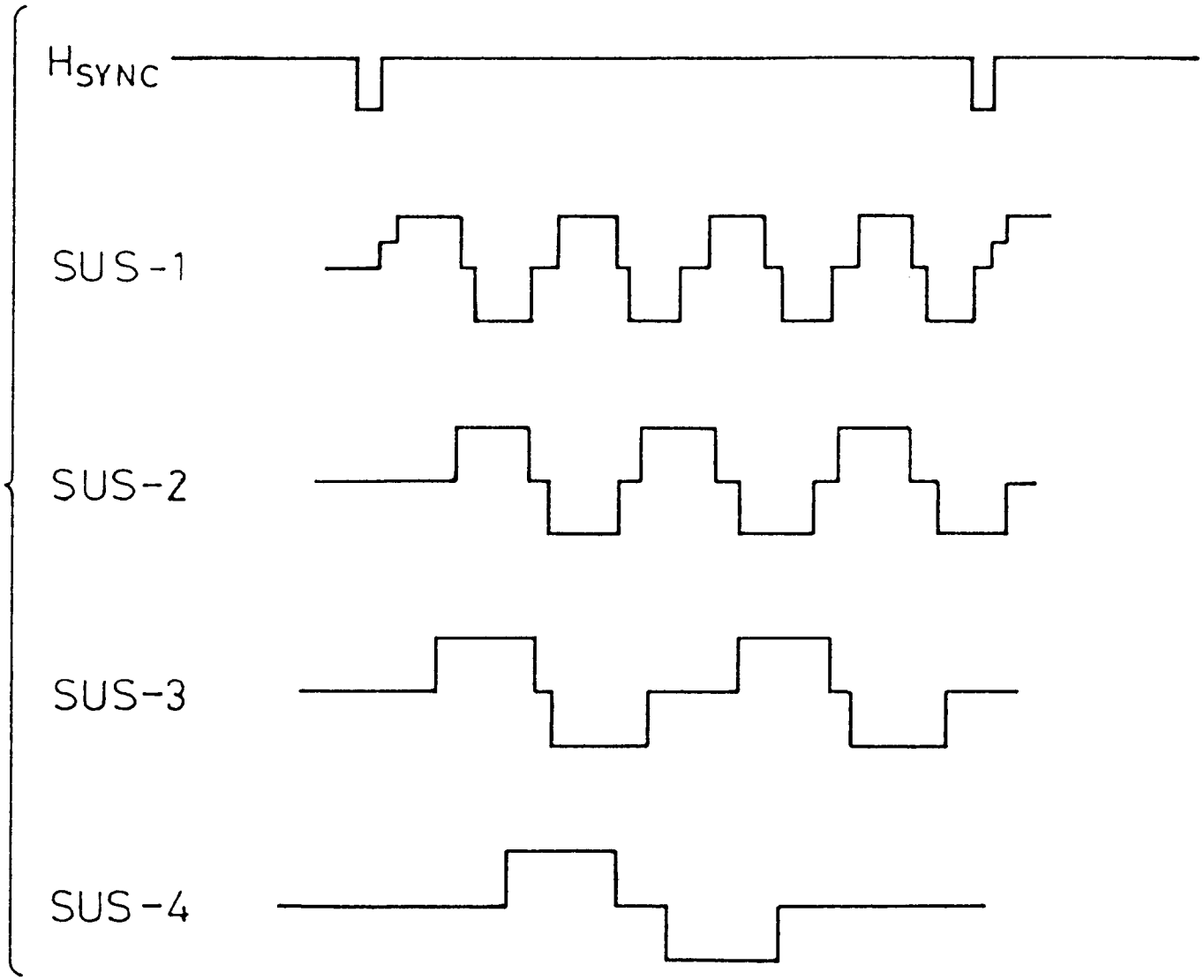
FIG. 10 shows examples of wave data employed in a flat display according to the present invention.

How to change brightness levels will be described more particularly. Four-waveform data including different weights, SUS-1 to SUS-4, are specified as shown in FIG. 10 as indicators for indicating the numbers of sustaining discharge cycles occurring during one line or one $H_{SYNC}$ pulse. Using an appropriate select signal, any of the wave data SUS-1 to SUS-4 is selected to execute a sustaining discharge. Four select signals to be associated with the waveform data SUS-1 to SUS-4 are created by differently combining two bit signals BD00 and BD01.

The number of waveform data is not limited to four but may be eight or more.

The numbers of sustaining discharge cycles defining the four waveform data SUS-1 to SUS-4 may have a relationship of 1:2:4:8. Alternatively, the number of sustaining discharge cycles per $H_{SYNC}$ pulse may be set to 5 for the SUS-1 waveform data, 4 for the SUS-2 waveform data, 3 for the SUS-3 waveform data, and 2 for the SUS-4 wave data.

As mentioned above, the number of sustaining discharge cycles per $H_{SYNC}$ pulse is varied depending on selected waveform data SUS. This makes it possible to change the brightness for a frame to be displayed on the flat display.

Figure 11:
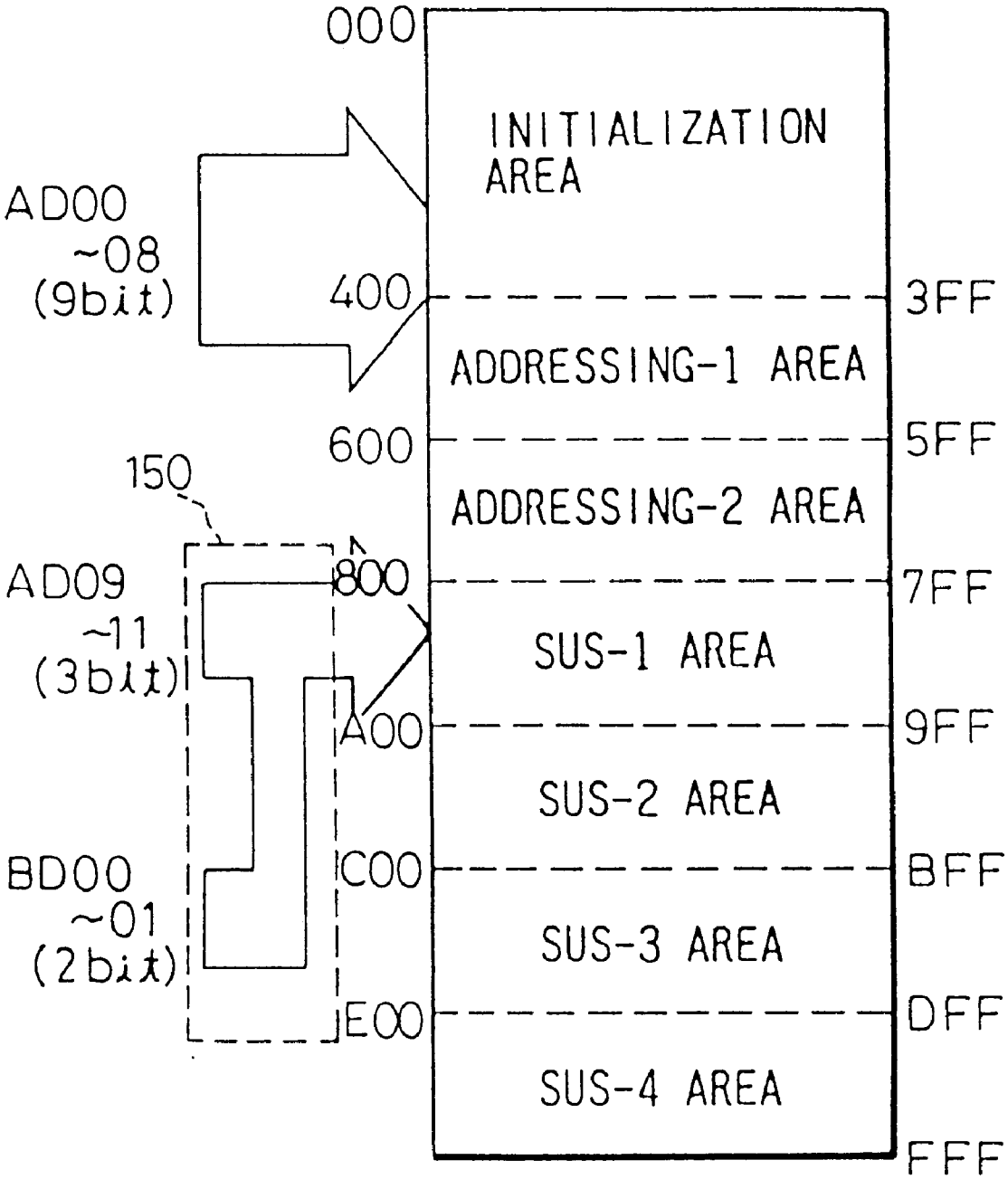
FIG. 11 is an explanatory diagram concerning the principle of drive in another example of a flat display according to the present invention.

FIG. 11 is an explanatory diagram showing control signals and storage areas in a ROM which are used in executing the aforesaid operation. The address signals AD00 to AD08 indicate an initialization area and addressing areas. During a sustaining discharge period, the address signals AD00 to AD08 are used to produce alternate pulses for sustaining discharge.

The address signals AD09 to AD11 are, as mentioned above, control signals for use in selecting a mode. The address signal AD11 indicates a sustaining discharge period. The remaining address signals AD09 and AD10 are used to produce a signal for selecting any of the foregoing waveform data SUS-1 to SUS-4.

More particularly, a switching circuit 150 switches the external signals BD00 and BD01 to the address signals AD09 and AD10 or vice versa. An algorithm is created so that when the BD00 and BD01 signals are low, the SUS-1 waveform data is selected, when the BD00 and BD01 signals are low and high respectively, the SUS-3 waveform data is selected, and that when the BD00 and BD01 signals are high, the SUS-4 waveform data is selected. When displaying is executed, a waveform data select signal is designated for each line or each frame. Thus, the brightness of a display screen can be varied appropriately.

Figure 12:
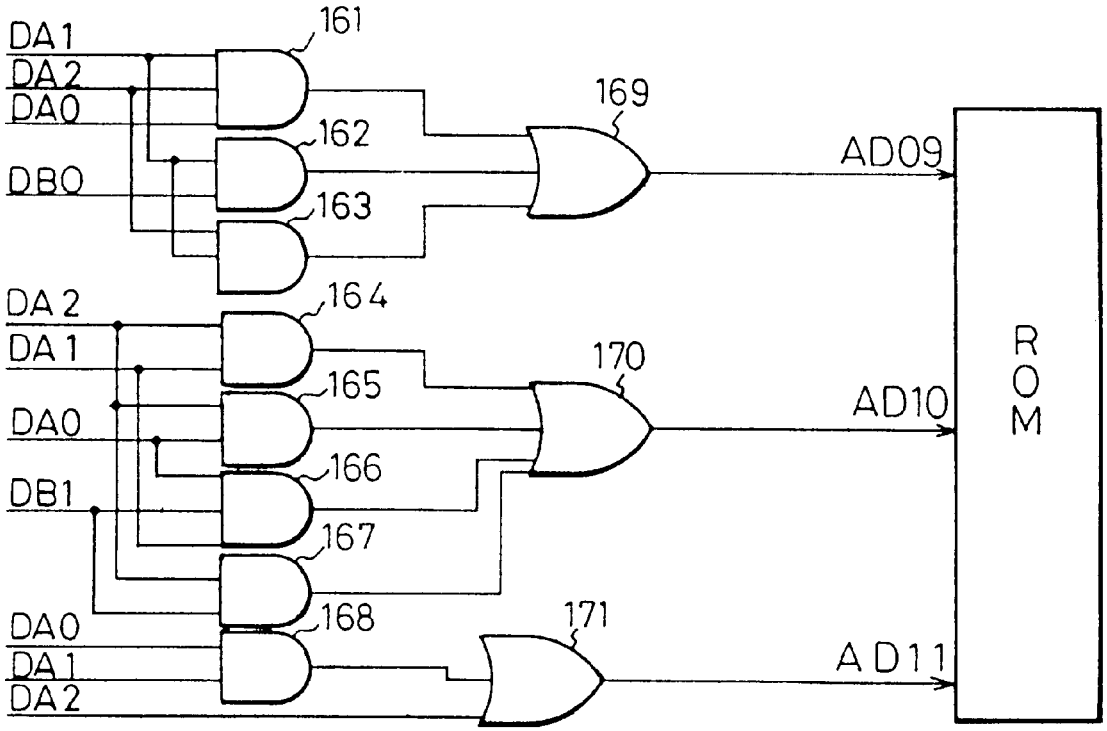
FIG. 12 is a block diagram for explaining an example of a configuration of a data switching means employed in the flat display shown in FIG. 11.

FIG. 12 is a block diagram showing a configuration of an example of the switching means 150 for switching the aforesaid BD00 and BD01 signals, which are external signals, to the address signals AD09 and AD10 or vice versa.

In the switching circuit 150, AND gates 161 to 167 and OR gates 169 to 171 are connected as shown in FIG. 12. Input terminals DA0 to DA2 receive the address signals, and input terminals DB0 and DB1 receive the external signals BD00 and BD01.

An output terminal A0 transmits the AD09 signal, an output terminal A1 transmits the AD10 signal, and an output terminal A2 transmits the AD11 signal.

Next, another example of a flat display according to the present invention will be described as the third embodiment with reference to FIG. 13.

Figure 13:
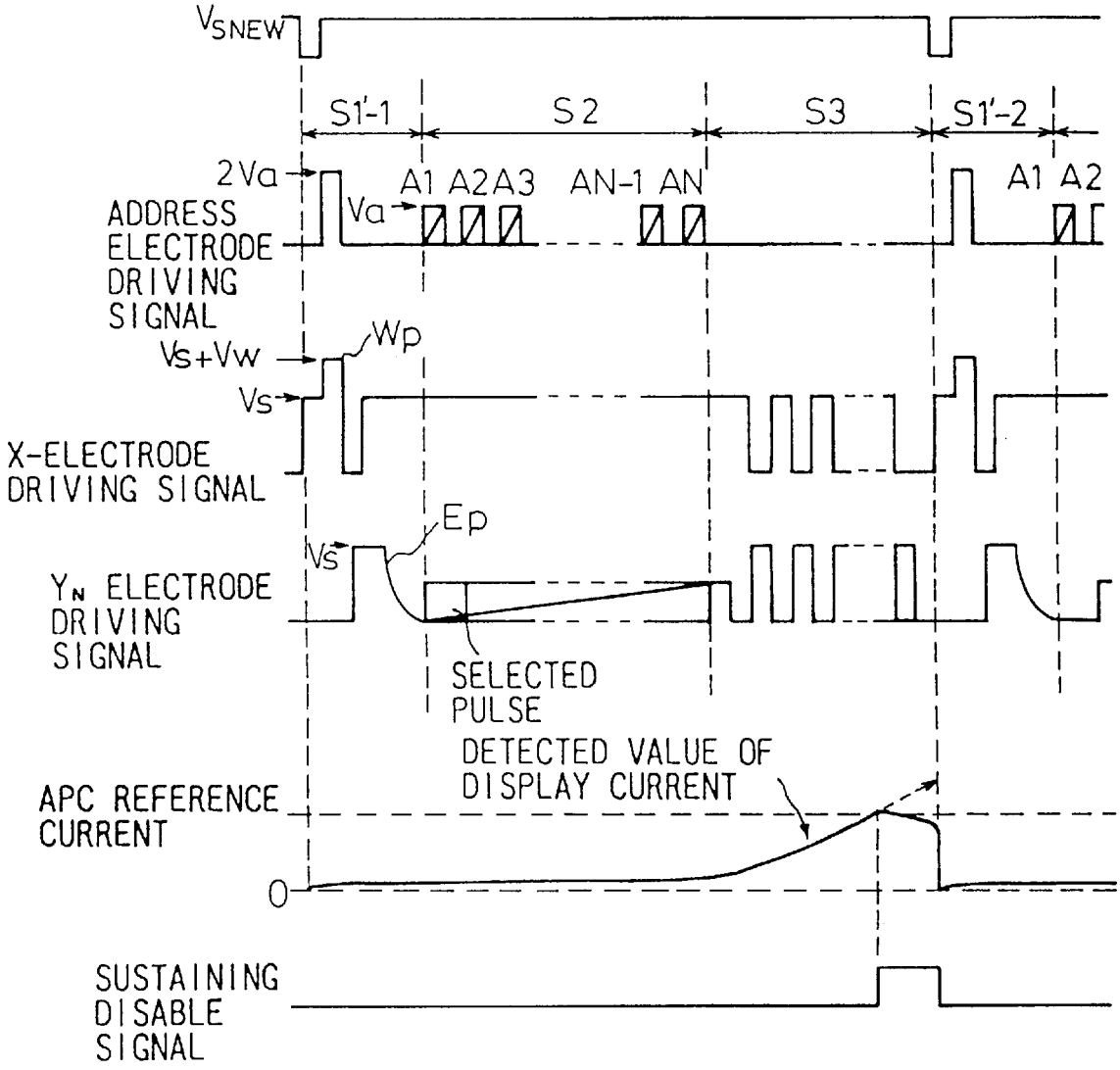
FIG. 13 is a timing chart for explaining drive timing in another example of a flat display according to the present invention.

In the flat display according to the present invention, when a given image is to be displayed, as shown in FIG. 13, current flowing through the flat display during an initialization period S1' or an addressing period S2 is not so large as to pose a problem in practice. The current remarkably increases during a sustaining discharge period S3.

Supposing no measure were taken against the increase in current, a power consumption would increase. This is uneconomical.

In this embodiment, current flowing through the flat display is detected using an appropriate current detecting means. When a current value exceeds a predetermined reference value, sustaining discharge is suspended.

Specifically, an automatic power control (APC) circuit for minimizing power consumed by a display power supply is installed as part of a control circuit for the flat display according to the present invention.

The current detecting circuit in this embodiment is not limited to any specific one. Any conventionally-known current detecting circuit may be usable.

In short, when the current detecting circuit in this embodiment determines that a current value exceeds a given reference value, a sustaining discharge disable pulse as that shown in FIG. 13 is output to suspend a sustaining discharge. Thus, light emission resulting from sustaining discharge is stopped.

Next, yet another example of a flat display according to the present invention will be described as the fourth embodiment.

The aforesaid flat display according to the present invention is such that: $V_{SYNC}$ and $H_{SYNC}$ signals fed externally are detected; batch writing/erasure is executed at a time preceding, by three $H_{SYNC}$ pulses, the instant of input of the $V_{SYNC}$ signal; and thus display data fed immediately after the $V_{SYNC}$ signal can be displayed satisfactorily. The fourth embodiment expands the technical concept, further comprising a facility that autonomously sets an initialization period at a time instant, preceding that of data writing, in response to and according to a display data transmission signal fed by any host, and thus produces a driving signal whose wave depends on a time instant at which the host issues a control signal.

As described above, the $V_{SYNC}$ signal is used as a reference. However, a time instant at which the $V_{SYNC}$ signal is input differs from host to host.

To provide more freedom for a host, a signal indicating a point at which data begins is supplied separately. Counting the number of $H_{SYNC}$ pulses is then started at the start point. A signal saying that addressing be started at a given point preceding the start point can then be produced in a similar manner as that described previously. This exerts the effect of making it unnecessary to specify the number of $H_{SYNC}$ pulses occurring before the start point.

For example, a display timing signal can be used in this embodiment.

As described so far, according to the present invention, even if a host starts transmitting data immediately after issuing a frame start control signal $V_{SYNC}$ an internal display start signal $V_{SNEW}$ is produced independently to control other circuits. Thus, initialization can be executed in a batch writing/erasure mode and driving can be effected in an addressing mode of an addressing/sustaining discharge separated style. This results in stable display quality. The present invention thus contributes greatly to improvement of performance of a triple-electrode color plasma display.

According to the present invention, a required display start signal $V_{SNEW}$ corresponding to a frame start control signal $V_{SYNC}$ is produced actively in a flat display during a time interval after the frame start control signal $V_{SYNC}$ is sent from an external unit until the next frame start control signal $V_{SYNC}$ is sent therefrom. Thus, a period of initialization can be specified uniquely. Furthermore, the display start signal $V_{SNEW}$ can be issued at any time instant preceding a time instant at which the frame start control signal $V_{SNEW}$ is input. Initialization starting can therefore be executed for a frame earlier than that in the prior art. Even when a data signal for the first line follows immediately after a frame start signal, an image can be displayed with stable display quality. Furthermore, an image input signal can be received from any host.

What is claimed is:

1. A flat display in which a display is formed on a display screen in successive units of frames, each unit of an individual frame and each frame consisting of plural subframes, each subframe having an initialization period during which the display screen is initialized, an addressing period during which display data is written into the display screen and a sustaining discharge period during which the written display data is displayed on the display screen, the flat display comprising:

an initialization start time control unit controlling an initialization start time of the initialization period and including:

an arithmetic logic unit calculating a pulse spacing of successive frame start control signals, each for one frame, by detecting an input of the frame start control signal $V_{SYNC}$, and a subtracting unit subtracting a time interval of the initialization period, defined by a predetermined number of pulses in a horizontal synchronizing signal $H_{SYNC}$, from the pulse spacing of the display start signal for the one frame, and a determining unit determining a time at which the time interval provided by the subtracting unit has passed from a time of issuance of the display start signal for one frame, as the initialization start time for the frame.

2. A flat display according to claim 1, wherein said initialization period in one sub-frame is a period during which given data are written or erased in or from associated cells, simultaneously, in order to initialize the display screen.

3. A flat display according to claim 1, wherein sets of three electrodes are used to perform driving for display of an image.

4. A flat display according to claim 3, wherein said flat display is a triple-electrode type color display.

5. A flat display according to claim 1, further comprising: a control unit varying a number of sustaining discharge cycles occurring in a unit time interval, which is one $H_{SYNC}$ pulse spacing, during the sustaining discharge period in a sub-frame, wherein the brightness of the display screen is controlled.

6. A flat display according to claim 1, further comprising:

a display power supply; and an automatic power control circuit minimizing power consumed by the display power supply.

7. A flat display according to claim 1, further comprising:

a facility that autonomously sets the period of initialization in response to, and according to, a display data transmission signal sent from any sending host, and produces a driving signal whose wave shape depends on a time at which said sending host issues a control signal.

8. A timing control unit controlling a display on a display screen of display data supplied in successive frames of display data at a frame timing rate defined by respective, successive frame start control signals $V_{SYNC}$, each individual frame comprising plural successive subframes at a subframe timing rate defined by respective, successive pulses of a horizontal synchronization $H_{SYNC}$, comprising:

a control unit determining from the frame timing rate the duration of an individual frame of display data, of the successive frames of display data, and defining an initialization interval, during which the display screen is initialized for display of each individual frame of display data, as extending from a corresponding initialization start time preceding the respective frame start control signal $V_{SYNC}$ for the individual frame of display data by a composite time interval defined by a prescribed number of the pulses of the horizontal synchronizing signal $H_{SYNC}$, the control unit further comprising:

an arithmetic logic unit subtracting the composite time interval, defined by the prescribed number of pulses of the horizontal synchronizing signal $H_{SYNC}$, from a frame time interval, defined by the time spacing of two successive frame start control signals $V_{SYNC}$, to determine a net time interval, and a timing unit setting the initialization start time, for a frame of display data having a given frame start control signal $V_{SYNC}$, at the conclusion of the net time interval following the respectively next preceding frame start control signal $V_{SYNC}$.

9. A method of controlling a display on a display screen of display data supplied in successive frames of display data at a frame timing rate defined by respective, successive frame start control signals $V_{SYNC}$, each individual frame comprising plural successive subframes at a subframe timing rate defined by respective, successive pulses of a horizontal synchronization $H_{SYNC}$, comprising:

determining from the frame timing rate the duration of an individual frame of display data, of the successive frames of display data;

defining an initialization interval, during which the display screen is initialized for display of each individual frame of display data, as extending from a corresponding initialization start time preceding the respective frame start control signal $V_{SYNC}$, for the individual frame of display data by a composite time interval defined by a prescribed number of the pulses of the horizontal synchronizing signal $H_{SYNC}$; and subtracting the composite time interval, defined by the prescribed number of pulses of the horizontal synchronizing signal $H_{SYNC}$, from a frame time interval, defined by the time spacing of two successive frame start control signals $V_{SYNC}$, to determine a net time interval; and setting the initialization start time, for a frame of display data having a given frame start control signal $V_{SYNC}$, at the conclusion of the net time interval following the respectively next preceding frame start control signal $V_{SYNC}$.

* * * * *